US009070361B2

(12) United States Patent
Gibbs

(10) Patent No.: US 9,070,361 B2
(45) Date of Patent: Jun. 30, 2015

(54) METHOD AND APPARATUS FOR ENCODING A WIDEBAND SPEECH SIGNAL UTILIZING DOWNMIXING OF A HIGHBAND COMPONENT

(75) Inventor: Jonathan A. Gibbs, Winderemere (GB)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 977 days.

(21) Appl. No.: 13/157,371

(22) Filed: Jun. 10, 2011

(65) Prior Publication Data

US 2012/0316885 A1 Dec. 13, 2012

(51) Int. Cl.

| | |
|---|---|
| ***G10L 19/00*** | (2013.01) |
| ***G10L 19/02*** | (2013.01) |
| ***G10L 21/038*** | (2013.01) |
| *G10L 19/24* | (2013.01) |

(52) U.S. Cl.

CPC ..... *G10L 19/0208* (2013.01); *G10L 19/24* (2013.01); *G10L 21/038* (2013.01)

(58) Field of Classification Search

CPC .... G10L 19/0208; G10L 19/24; G10L 21/038
USPC ..... 704/500–501, E21.011
See application file for complete search history.

(56) References Cited

U.S. PATENT DOCUMENTS

| | | | | |
|---|---|---|---|---|
| 5,818,212 | A | 10/1998 | Min et al. | |
| 6,104,822 | A * | 8/2000 | Melanson et al. | 381/320 |
| 6,182,031 | B1 * | 1/2001 | Kidder et al. | 704/205 |
| 6,732,070 | B1 * | 5/2004 | Rotola-Pukkila et al. | 704/219 |
| 6,947,509 | B1 | 9/2005 | Wong | |
| 7,328,162 | B2 | 2/2008 | Liljeryd et al. | |
| 2004/0125878 | A1 * | 7/2004 | Liljeryd et al. | 375/242 |
| 2005/0276335 | A1 * | 12/2005 | Kumar | 375/260 |
| 2006/0277038 | A1 * | 12/2006 | Vos et al. | 704/219 |
| 2008/0126086 | A1 * | 5/2008 | Vos et al. | 704/225 |
| 2008/0140393 | A1 | 6/2008 | Kim et al. | |
| 2008/0263285 | A1 * | 10/2008 | Sharma et al. | 711/147 |

(Continued)

FOREIGN PATENT DOCUMENTS

| | | | |
|---|---|---|---|
| CN | 101868821 | A | 10/2010 |
| WO | 0150458 | A1 | 7/2001 |
| WO | 2009063728 | A1 | 5/2009 |

OTHER PUBLICATIONS

Luo, et al. "Wideband audio over narrowband based on digital watermarking." Wireless Communications, Networking and Information Security (WCNIS), 2010 IEEE International Conference on. IEEE, Jun. 2010, pp. 697-701.*

(Continued)

*Primary Examiner* — James Wozniak
(74) *Attorney, Agent, or Firm* — Birch, Stewart, Kolasch & Birch, LLP

(57) ABSTRACT

A method and apparatus for encoding a signal is provided herein. During operation a wideband signal that is to be encoded enters a filter bank. A highband signal and a lowband signal are output from the filter bank. Each signal is separately encoded. During the production of the highband signal, a downmixing operation is implemented after preprocessing, and prior to decimating. The downmixing operation greatly reduces system complexity. In fact, it will be observed that the highest sample rate in the prior-art implementation is 64 kHz whereas the sample rate in the system described above remains at 32 kHz or below. This represents a significant complexity saving, as do the reduced number of processing blocks.

17 Claims, 11 Drawing Sheets

(56) References Cited

U.S. PATENT DOCUMENTS

| | | | | |
|---|---|---|---|---|
| 2008/0298517 | A1* | 12/2008 | Izumi et al. | 375/344 |
| 2010/0274557 | A1* | 10/2010 | Oh et al. | 704/219 |
| 2010/0305956 | A1 | 12/2010 | Oh et al. | |
| 2011/0057818 | A1* | 3/2011 | Jung et al. | 341/50 |
| 2011/0295598 | A1* | 12/2011 | Yang et al. | 704/205 |
| 2012/0226496 | A1* | 9/2012 | Yoon et al. | 704/219 |
| 2012/0275607 | A1* | 11/2012 | Kjoerling et al. | 381/22 |

OTHER PUBLICATIONS

Patent Cooperation Treaty, International Search Report and Written Opinion of the International Searching Authority for International Application No. PCT/US2012/040844, Aug. 23, 2012, 14 pages.

Qian, Yasheng et al: "Classified Highband Excitation for Bandwidth Extension of Telephony Signals", Proceedings of Eusipco2005, all pages.

* cited by examiner

501

METHOD AND APPARATUS FOR ENCODING A WIDEBAND SPEECH SIGNAL UTILIZING DOWNMIXING OF A HIGHBAND COMPONENT

FIELD OF THE INVENTION

The present invention relates generally to encoding signals and in particular, to a method and apparatus for encoding speech signals.

BACKGROUND OF THE INVENTION

Current speech coders are being designed for ever increasing bandwidths. Extension of the range supported by a speech coder into higher frequencies may improve intelligibility. For example, the information that differentiates fricatives such as 's' and 'f' is largely in the high frequencies. Highband extension may also improve other qualities of speech, such as presence. For example, even a voiced vowel may have spectral energy far above the PSTN limit.

One approach to wideband speech coding involves scaling a narrowband speech coding technique to cover the wideband spectrum. For example, a speech signal may be sampled at a higher rate to include components at high frequencies, and a narrowband coding technique may be reconfigured to use more filter coefficients to represent this wideband signal. Narrowband coding techniques such as CELP (codebook excited linear prediction) are computationally intensive, however, and a wideband CELP coder may consume too many processing cycles to be practical for many mobile and other embedded applications. Encoding the entire spectrum of a wideband signal to a desired quality using such a technique may also lead to an unacceptably large increase in bandwidth. Moreover, transcoding of such an encoded signal would be required before even its narrowband portion could be transmitted into and/or decoded by a system that only supports narrowband coding.

In order to address this issue it has been proposed to have the encoder divide a wideband speech signal into a lowband signal, or narrowband signal, and a highband signal, then encode each signal separately. Such an encoder is described in United States Patent Application Publication 2008/0126086, entitled SYSTEMS, METHODS, AND APPARATUS FOR GAIN CODING, and incorporated by reference herein.

FIG. 1 shows a block diagram of a prior art wideband speech encoder 100. Filter bank 101 is configured to filter a wideband speech signal to produce a lowband signal at a lower bandwidth and a highband signal. Narrowband encoder 102 is configured to encode the lowband signal to produce narrowband filter parameters and a narrowband residual signal. Narrowband encoder 102 is typically configured to produce narrowband filter parameters and an encoded narrowband excitation signal as codebook indices or in another quantized form. Highband encoder 103 is configured to encode the highband signal according to information in the encoded narrowband excitation signal to produce highband coding parameters. Highband encoder 103 is typically configured to produce highband coding parameters as codebook indices or in another quantized form. One particular example of wideband speech encoder 100 is configured to encode wideband speech signal at a rate of about 8.55 kbps (kilobits per second), with about 7.55 kbps being used for narrowband filter parameters and encoded narrowband excitation signal, and about 1 kbps being used for highband coding parameters.

In a typical implementation, filter bank 101 comprises a low pass filter and a high pass filter. FIG. 2 and FIG. 3 show relative bandwidths of a wideband speech signal, lowband signal, and a highband signal in two different implementation examples. In both of these particular examples, the wideband speech signal has a sampling rate of 32 kHz (representing frequency components within the range of 0 to 16 kHz), and the lowband signal has a sampling rate of 16 kHz (representing frequency components within the range of 0 to 8 kHz).

In the example of FIG. 2, there is no significant overlap between the two sub bands. A highband signal as shown in this example may be obtained using a high pass filter with a passband of 8-16 kHz. In such a case, it may be desirable to reduce the sampling rate to 16 kHz by downsampling the filtered signal by a factor of two. Such an operation, which may be expected to significantly reduce the computational complexity of further processing operations on the signal, involves moving the passband energy down to the range of 0 to 8 kHz to prevent loss of information.

In the alternative example of FIG. 3, the upper and lower sub-bands have an appreciable overlap, such that the region of 7 to 8 kHz is described by both subband signals. Such an overlap may be expected to account for non-ideal filtering during the recombination of the upper and lower sub-bands after decoding of the lowband and highband parameters.

Considering an implementation according to FIG. 2 with a sampling rate of 32 kHz and in the case of a super wideband signal (50 Hz-14.0 kHz) with a 12.8 kHz sampled lowband component representing a signal from 0 to 6.4 kHz, a critically sampled 8 kHz bandwidth signal would be suitable to reproduce the highband component.

FIG. 4 shows a block diagram of a prior-art implementation of filter bank 101 that performs a functional equivalent of highpass filtering and downsampling operations using a series of interpolation, resampling, decimation, and other operations. In FIG. 4, lowpass filter 401 and downsampler 402 serve to generate the lowband speech signal, while interpolator 403, resampler 404, decimater 405, spectral reversal circuitry 406, decimator 407, and spectral shaping circuitry 408 server to generate highband speech signals.

Such an implementation may be easier to design and/or may allow reuse of functional blocks of logic and/or code. For example, the same functional block may be used to perform the operations of decimation by ⅖ to 12.8 kHz (402) and decimation by 5/11 to 16 kHz (407) as shown in FIG. 4. The spectral reversal operation may be implemented by multiplying the signal with the function $e^{jn\pi}$ or the sequence (−1)n, whose values alternate between −1 and −1. The spectral shaping operation may be implemented as a lowpass filter configured to shape the signal to obtain a desired overall filter response.

It is noted that as a consequence of the spectral reversal operation, the spectrum of highband signal is reversed. Subsequent operations in the encoder and corresponding decoder may be configured accordingly. For example, highband excitation generator as described herein may be configured to produce a highband excitation signal that also has a spectrally reversed form.

It will be observed that the highest sample rate in the above implementation is 64 kHz and the number of processing steps required to obtain a critically sampled version of the highband speech signal is six, indicating a relatively high degree of complexity before encoding may commence. Furthermore the flexibility of this approach is limited because of the need to achieve a critically sampled version of the highband speech signal, i.e. a sample rate which corresponds to precisely twice the upper frequency of the band to be coded. In this case the required sampling rate is 28.8 kHz to code the highband with an upper frequency of 14.4 kHz. Therefore a need exists for a method and apparatus for encoding signals that reduces the complexity with the above described encoder and enhances flexibility to code different highband configurations.

Figure 1:
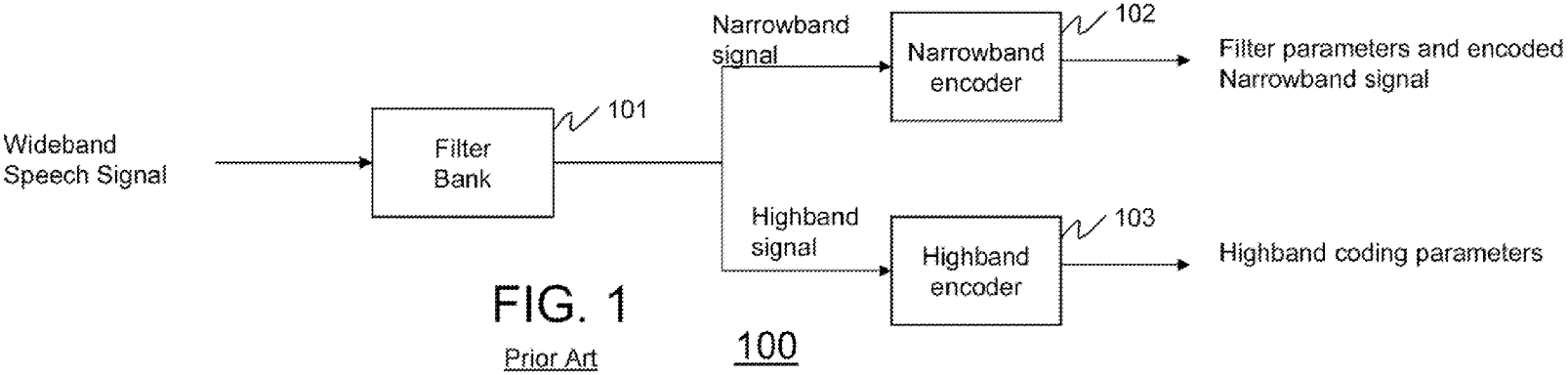
FIG. 1 Prior Art
FIG. 1 is a block diagram of a prior-art encoder.
Figure 2:
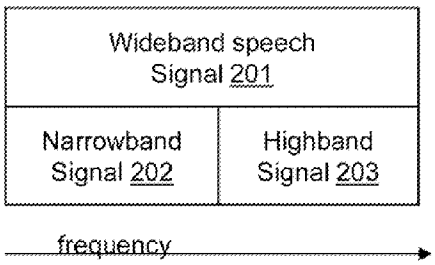
FIG. 2 Prior Art
FIG. 2 illustrates wideband speech and its lowband and highband components.
Figure 3:
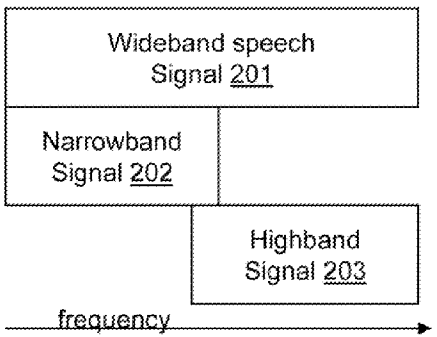
FIG. 3 Prior Art
FIG. 3 illustrates wideband speech and its lowband and highband components.
Figure 4:
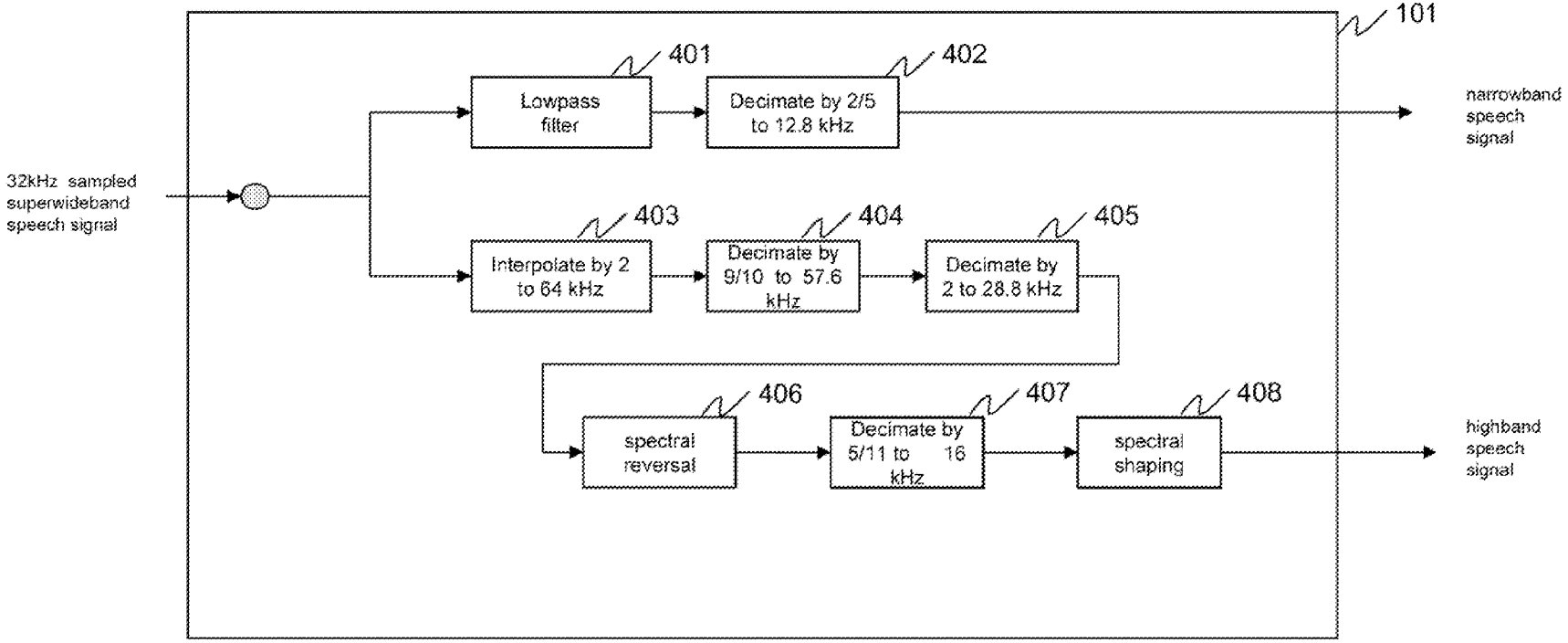
FIG. 4 Prior Art
FIG. 4 is a block diagram of a prior art filter bank for the encoder of FIG. 1.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. Those skilled in the art will further recognize that references to specific implementation embodiments such as "circuitry" may equally be accomplished via either on general purpose computing apparatus (e.g., CPU) or specialized processing apparatus (e.g., DSP) executing software instructions stored in non-transitory computer-readable memory. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION OF THE DRAWINGS

In order to satisfy the above-mentioned need, a method and apparatus for encoding a signal is provided herein. During operation a wideband signal that is to be encoded enters a filter bank. A highband signal and a lowband signal are output from the filter bank. Each signal is separately encoded. During the production of the highband signal, a downmixing operation is implemented after spectral reversal, and prior to decimating. The downmixing operation greatly reduces system complexity. In fact, it will be observed that the highest sample rate in the prior-art implementation is 64 kHz whereas the sample rate in the system described above remains at 32 kHz or below. This represents a significant complexity saving, as do the reduced number of processing blocks.

The present invention encompasses a method for encoding a signal. The method comprises the steps of receiving a wideband signal at a filter bank, filtering the wideband signal to produce a lowband signal and a highband signal, encoding the lowband signal with a narrowband encoder, and encoding the highband signal with a highband encoder. The step of filtering the wideband signal to produce the highband signal comprises the steps of spectrally reversing the wideband signal to produce a spectrally-reversed signal and downmixing the spectrally-reversed signal to produce a down mixed signal.

The present invention additionally encompasses a method for decoding a signal. The method comprises the steps of decoding a first signal with a narrowband decoder to produce a lowband signal, decoding a second signal with a highband decoder to produce highband signal, and combining the lowband and the highband signals. The step of combining the lowband and the highband signals comprises the steps of spectrally reversing the highband signal, downmixing the spectrally-reversed signal, and adding the down mixed signal with a narrowband speech signal.

The present invention additionally encompasses an apparatus comprising a filter bank receiving a wideband signal and outputting a lowband signal and a highband signal, a narrowband encoder encoding the lowband signal, and a highband encoder encoding the highband signal. The filter bank comprises spectral reversal circuitry spectrally reversing the wideband signal to produce a spectrally-reversed signal, downmixing circuitry downmixing the spectrally-reversed signal to produce a down mixed signal.

The present invention additionally encompasses an apparatus comprising a first decoder decoding a first signal to produce a lowband signal, a second decoder decoding a second signal to produce highband signal, spectral reversal circuitry spectrally reversing the highband signal to produce a spectrally-reversed signal, downmixing circuitry downmixing the spectrally-reversed signal to produce a down mixed signal, and an adder adding the down mixed signal with a narrowband speech signal.

Figure 5:
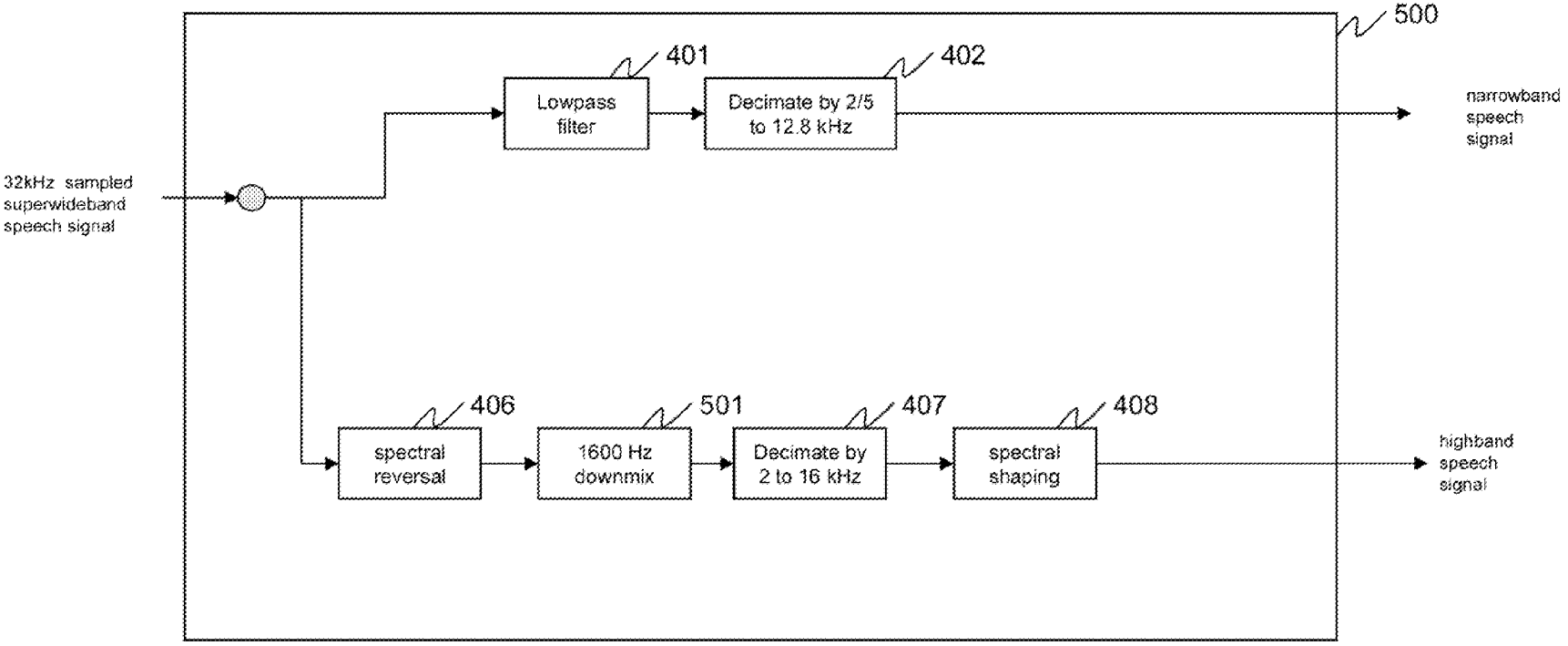
FIG. 5 is a block diagram of a filter bank.

Turning now to the drawings, where like numerals designate like components, FIG. 5 is a block diagram of a filter bank. As is evident, the filter of FIG. 5 comprises downmixing circuitry 501. Preprocessing prior to dowmixing takes downmixing takes place by spectral reversing circuitry 406. Downmixing circuitry 501 serves to downmix the pre-processed (i.e., a spectrally reversed) signal output from spectral reversal circuitry 406. More particularly, during downmixing a signal is shifted in frequency by a predetermined amount. A more-detailed block diagram of downmixer 501 is shown in FIG. 6.

Figure 6:
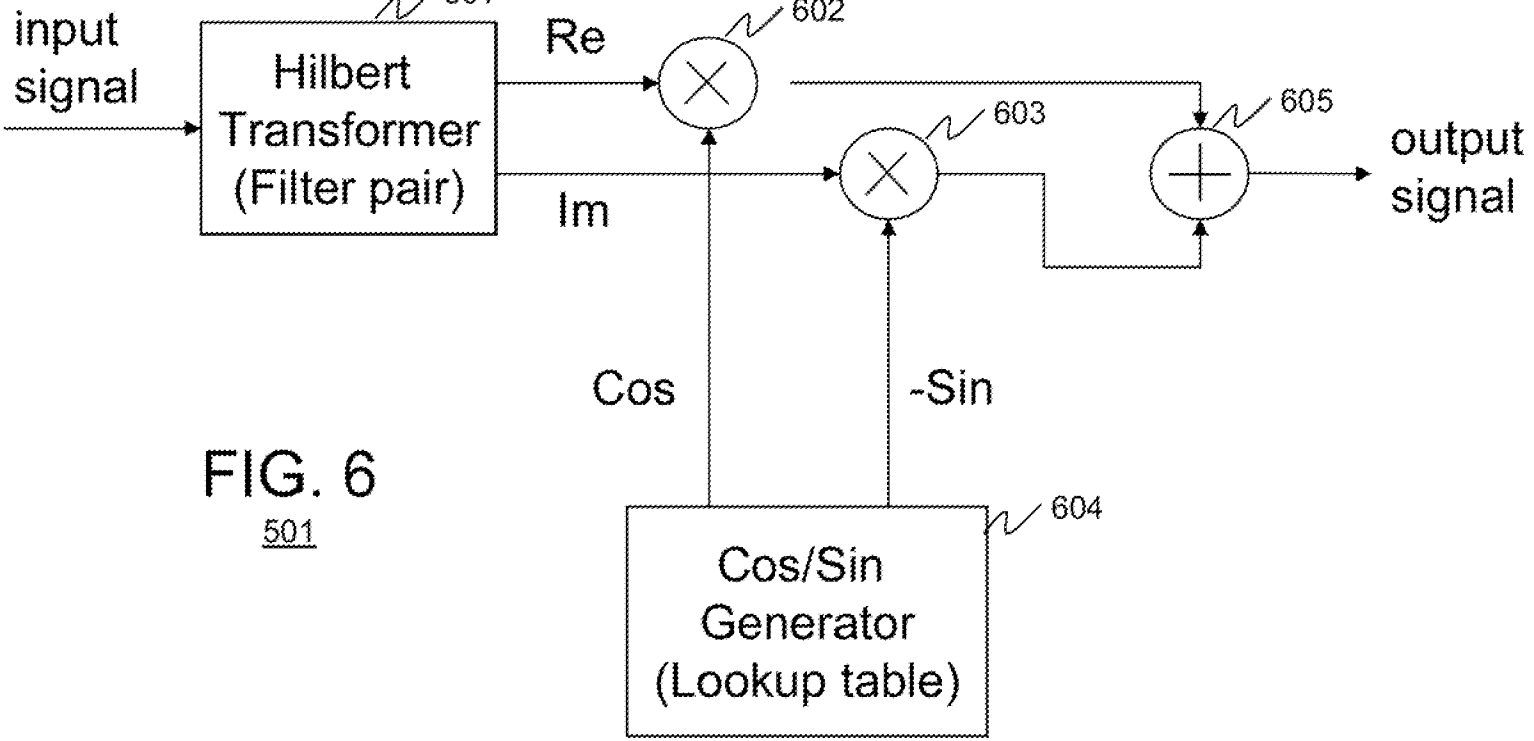
FIG. 6 is a block diagram of the downmixer of FIG. 5.

As shown in FIG. 6, downmixer 501 comprises Hilbert transform circuitry 601, mixers 602 and 603, sine/cosine generator 604, and summing circuitry 605. Downmixing, for example, of a 1600 Hz signal is accomplished by represented the pre-processed input signal at 32 kHz as a sine wave of exactly 20 samples period. In order to achieve the 1600 Hz spectral downmixing process, it is necessary to derive quadrature components of the spectrally reversed input signal. This may be achieved via circuitry 601 with a Hilbert Transformer which is an all-pass filter with phase response equal to a $\pi/2$ shift for all frequencies applied to the input signal only to derive the Imaginary output (Im). In practice it is easier to derive a pair of all-pass filters with outputs which are $\pi/2$ out of phase with one another over all frequencies. One such filter pair are;

$$H_r(z) = \frac{z^{-1}\begin{pmatrix} 0.409203611 - 2.149822809z^{-2} + \\ 4.070339174z^{-4} - 3.329716205z^{-6} + z^{-8} \end{pmatrix}}{\begin{pmatrix} 1.0 + 3.329716205z^{-2} - 4.070339174z^{-4} + \\ 2.149822809z^{-6} - 0.409203611z^{-8} \end{pmatrix}}$$

$$H_i(z) = \frac{\begin{pmatrix} 0.111039799 - 1.067487518fz^{-2} + \\ 2.787298979z^{-4} - 2.830736288z^{-6} + z^{-8} \end{pmatrix}}{\begin{pmatrix} 1.0 + 2.830736288z^{-2} - 2.787298979z^{-4} + \\ 1.067487518z^{-6} - 0.111039799z^{-8} \end{pmatrix}}$$

These two filters, when applied to an input signal, will yield two quadrature versions of that input signal (real (Re) and imaginary (Im)). It will be observed that although each of the filters have numerators and denominators of order 8, only even powers of z are non-zero and therefore the filters only require a total of 8 multiply-accumulates per sample. It is also evident that they have all-pass characteristics since the magnitudes of the numerator and denominator coefficients are time reversals of one another.

In order to downmix these two quadrature versions of the signal by 1600 Hz, quadrature versions of a −1600 Hz tone signal, sampled at the same sample rate, must be complex multiplied by the quadrature input signal samples. This is accomplished by mixers 602 and 603.

The mixed tone is of the form $e^{-jT^{2\pi f/f_s}}$ where T is a sample index, f is the frequency translation in Hz and $f_s$ is the sample rate in Hz. Therefore for 1600 Hz sampled at 32 kHz is of the form $e^{-jT^{2\pi 1600/32000}}$.

The −1600 Hz quadrature tone signal sampled at 32 kHz requires just 25 words of storage in table 604 since the cosine and sine values overlap as shown below and repeat every 20 samples.

| | | |
|---|---|---|
| cos(0) | | = 1.0 |
| cos(π/10) | | = 0.951056516 |
| cos(π/5) | | = 0.809016994 |
| cos(3π/10) | | = 0.587785252 |
| cos(2π/5) | | = 0.309016994 |
| cos(π/2) | = −sin(0) | = 0.0 |
| cos(3π/5) | = −sin(π/10) | = −0.309016994 |
| cos(7π/10) | = −sin(π/5) | = −0.587785252 |
| cos(4π/5) | = −sin(3π/10) | = −0.809016994 |
| cos(9π/10) | = −sin(2π/5) | = −0.951056516 |
| cos(π) | = −sin(π/2) | = −1.0 |
| cos(11π/10) | = −sin(3π/5) | = −0.951056516 |
| cos(6π/5) | = −sin(7π/10) | = −0.809016994 |
| cos(13π/10) | = −sin(4π/5) | = −0.587785252 |
| cos(7π/5) | = −sin(9π/10) | = −0.309016994 |
| cos(3π/2) | = −sin(π) | = 0.0 |
| cos(8π/5) | = −sin(11π/10) | = 0.309016994 |
| cos(17π/10) | = −sin(6π/5) | = 0.587785252 |
| cos(9π/5) | = −sin(13π/10) | = 0.809016994 |
| cos(19π/10) | = −sin(7π/5) | = 0.951056516 |
| | −sin(3π/2) | = 1.0 |
| | −sin(8π/5) | = 0.951056516 |
| | −sin(17π/10) | = 0.809016994 |
| | −sin(9π/5) | = 0.587785252 |
| | −sin(19π/10) | = 0.309016994 |

Only the real samples of this complex multiplication are required for storage which reduces the complex multiplication to the following;

$$\text{output}[i]=\text{input}_{Real}[i]\cdot\text{cos_table}[j]+\text{input}_{Image}[i]\cdot\text{sine_table}[j]$$

where the sample counter j is equal to counter i modulo 20 (i % 20).

In the context of generating the high band component of a super wideband signal using a 12.8 kHz sampled core, the operations of a spectral-flip followed by 1600 Hz downmix represent a useful processing block. Particularly since this combination of operations are self-inverse for band-limited signals. The resulting signals are summed by summer 605 and output to decimator 407.

Figure 7:
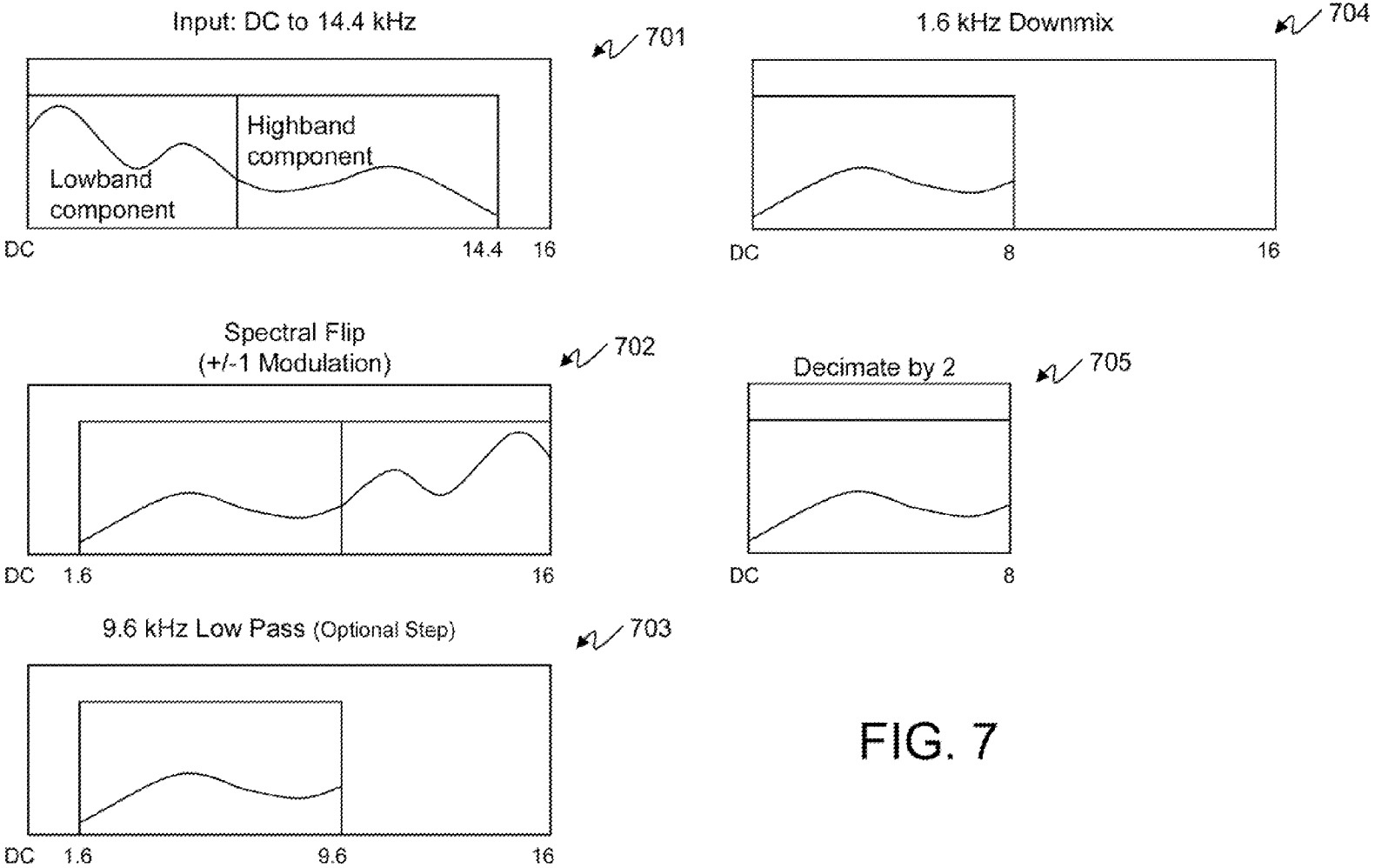
FIG. 7 illustrates filtering with the filter bank of FIG. 5.

FIG. 7 illustrates filtering with the filter bank of FIG. 5. The input signal 701 is fed into preprocessing circuitry, which in this case comprises spectral reversal circuitry 406. Circuitry 406 comprises a 32 kHz sampled signal occupying a bandwidth of 14.4 kHz with a highband component and a lowband component (sometimes referred to as a narrowband component). After spectral flipping (702), the resulting signal exists between 1.6 kHz and 16 kHz, with the highband component lower in frequency than the lowband component. At this point, the lowband component may be filtered off (703) via a filter (not shown in FIG. 6). During downmixing by downmixer 501, the resulting highband component is shifted in frequency by 1600 Hz (704). Finally, the 16 kHz signal is decimated by 2 via decimator 407, resulting in signal 705.

Figure 8:
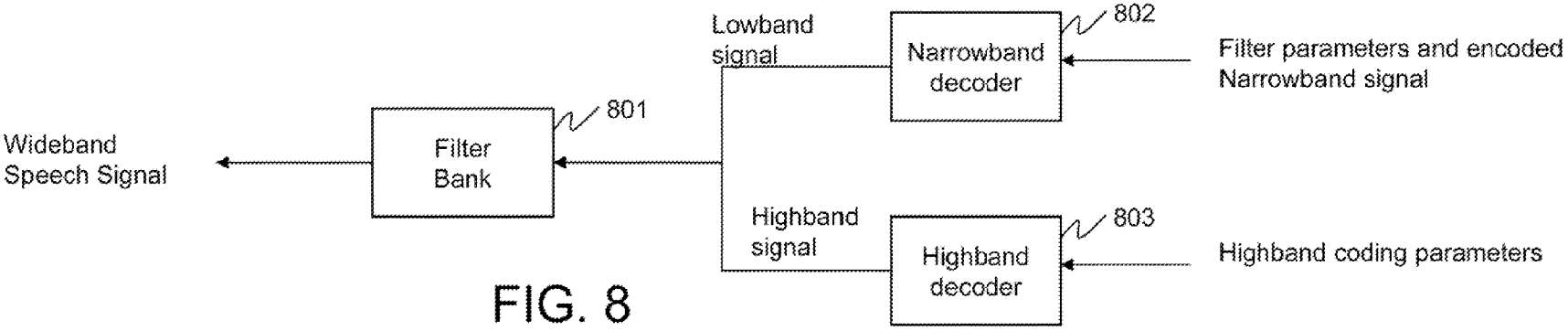
FIG. 8 Prior Art
FIG. 8 is a block diagram of a prior-art decoder.
Figure 9:
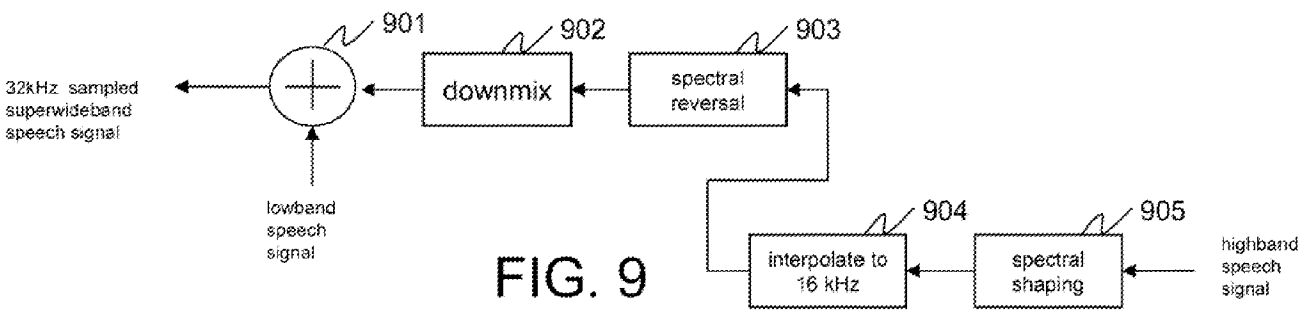
FIG. 9 is a block diagram of decoder.

FIG. 8 is a block diagram of a prior-art decoder. As shown, the decoder of FIG. 8 comprises both narrowband decoder 802 and highband decoder 803. Like the encoder, filter bank 801 is provided to properly combine the lowband and highband signals. As described above, complexity issues exist with the prior-art filter banks. In order to address this issue the filter described above is provided. This is illustrated in FIG. 9. As shown in FIG. 9, downmixer 902 is provided. Downmixer 902 is similar to the downmixer described above, with its operation being described in FIG. 10.

Figure 10:
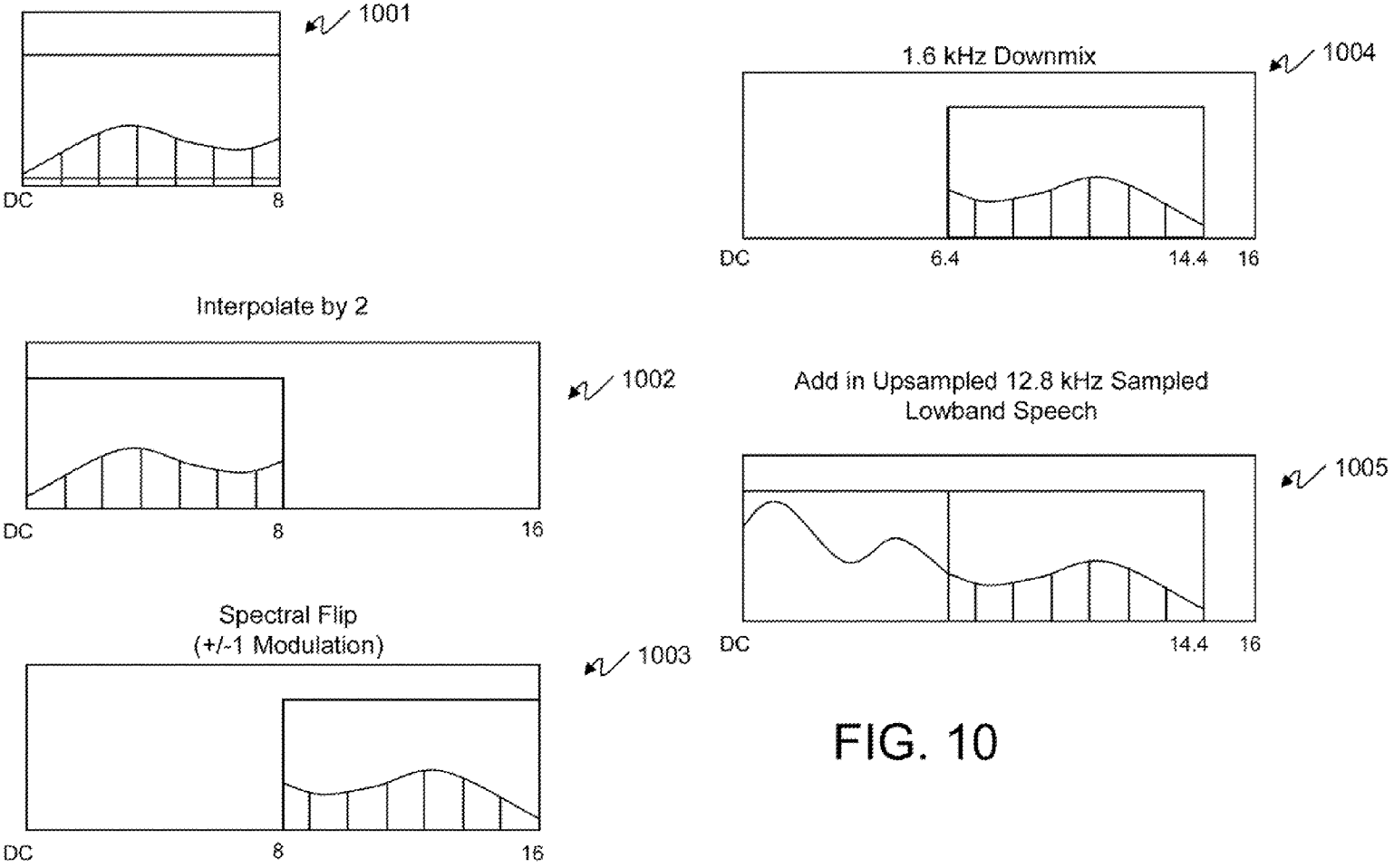
FIG. 10 illustrates decoding with the decoder of FIG. 9.

FIG. 10 illustrates decoding with the decoder of FIG. 9. During operation input signal 1001 enters interpolator 904 where an interpolation takes place, expanding it in frequency. This is shown as signal 1002. Spectral flip circuitry 903 flips (reverses) the resulting signal to produce flipped signal 1003 (preprocessed signal). Downmixer 902 then shifts the highband portion of signal 1003 by a predetermined amount to produce signal 1004. Finally the lowband signal is added by adder 901 resulting in signal 1005.

In all of the above-described downmixing operations, the steps of spectral flip and 1600 Hz downmix are employed in both the encoding process to derive the target signal in the encoder and in the decoder during the conversion of the critically sampled highband signal to the 32 kHz sampled synthetic speech at the output of the decoder. The order of the processing steps of spectral flipping and Hilbert transformation/linear frequency translation may be interchanged.

Figure 11:
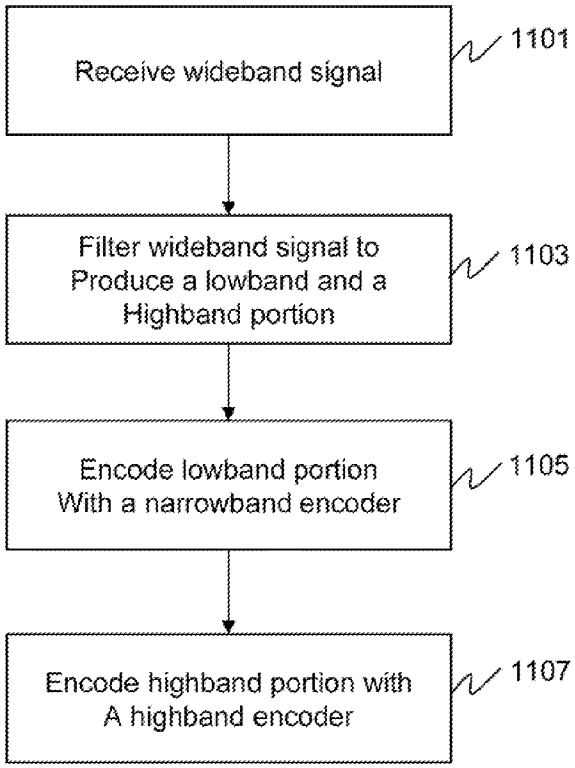
FIG. 11 is a flow chart showing operation of an encoder.

FIG. 11 is a flow chart showing operation of an encoder. The logic flow begins at step 1101 where a wideband signal (e.g., wideband speech) is received by filter bank 500. At step 1103, filter bank 500 filters the wideband signal to produce a lowband and a highband signal. The lowband signal is then encoded by narrowband encoder (step 1105) while the highband portion of the wideband signal is encoded by a highband encoder (step 1107).

Figure 12:
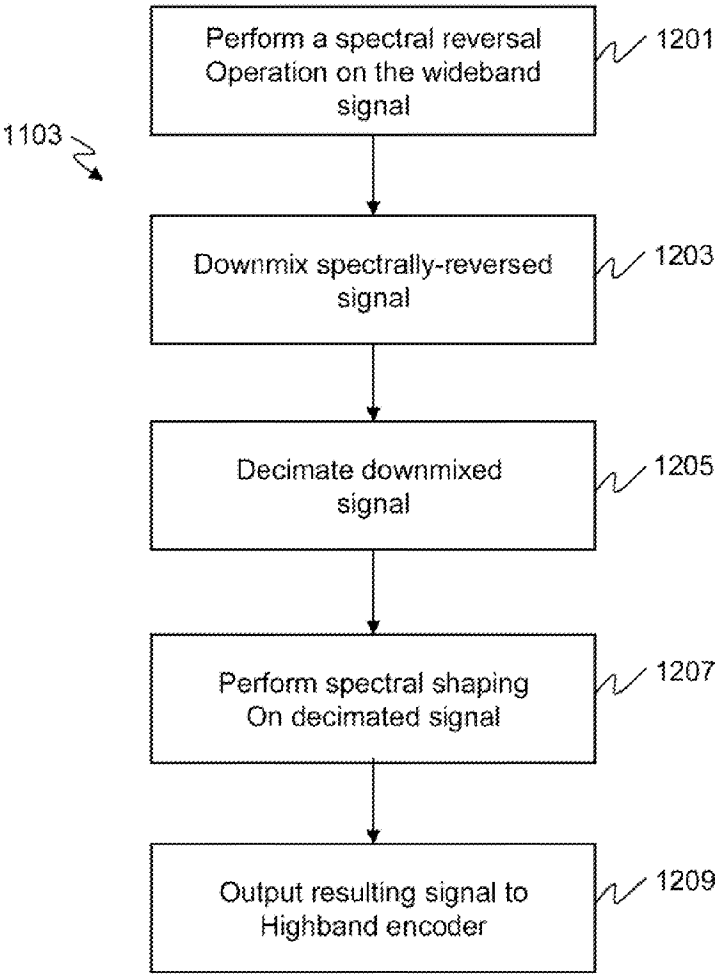
FIG. 12 is a flow chart showing operation of a filter bank.

FIG. 12 is a flow chart showing operation of a filter bank. In particular, FIG. 12 shows those steps performed at block 1103 for producing a highband signal. The logic flow begins at step 1201 where spectral reversal circuitry 406 performs a spectral reversal on the wideband signal. At step 1203 downmixer 501 then down mixes the spectrally-reversed signal. The logic flow continues to step 1205 where the down mixed signal is then decimated by decimator 407. Spectral shaping then takes place on the resulting signal at step 1207 by circuitry 408. Finally the resulting signal is then output to a highband encoder (step 1209).

Figure 13:
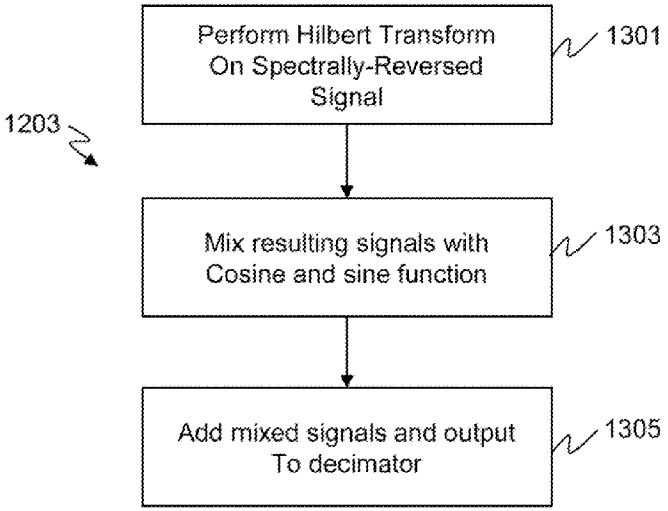
FIG. 13 is a flow chart showing the operation of a downmixer.

FIG. 13 is a flow chart showing the operation of downmixer 501 during step 1203, above. The logic flow begins at step 1301 where Hilbert Transform circuitry 601 performs a Hilbert transform on a preprocessed (e.g., spectrally-reversed) signal to produce two quadrature versions (real and imaginary) of the spectrally reversed signal. At step 1303 the resulting real and imaginary signals are mixed via mixers 602 and 603 with a cosine and sine function, respectively. Finally, at step 1305 the mixed signals are added via circuitry 605. The resulting signal is then output to decimator 407.

Figure 14:
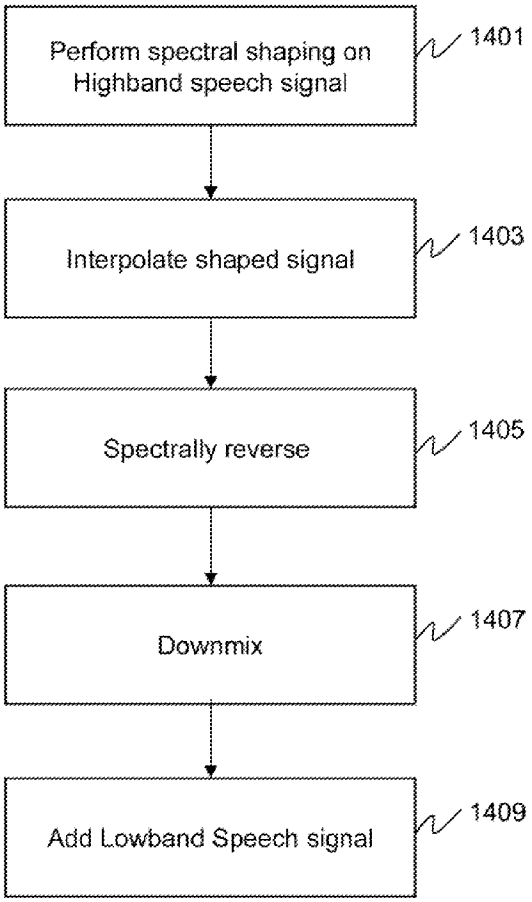
FIG. 14 is a flow chart showing the operation of the highband filter of FIG. 9.

FIG. 14 is a flow chart showing the operation of the highband filter of FIG. 9. The logic flow begins at step 1401 where spectral shaping is performed on a highband speech signal received from a highband encoder. This is accomplished via circuitry 905. At step 1403 circuitry 904 interpolates the spectrally-shaped signal. Next, at step 1405 the resulting signal is spectrally reversed by circuitry 903. The resulting signal is then sent to downmixer 902 where downmixing occurs (step 1407). Finally, the lowband signal is then added via adder 901 to the down mixed signal at step 1409. It should be noted that the step of downmixing occurs as illustrated in FIG. 13.

Figure 15:
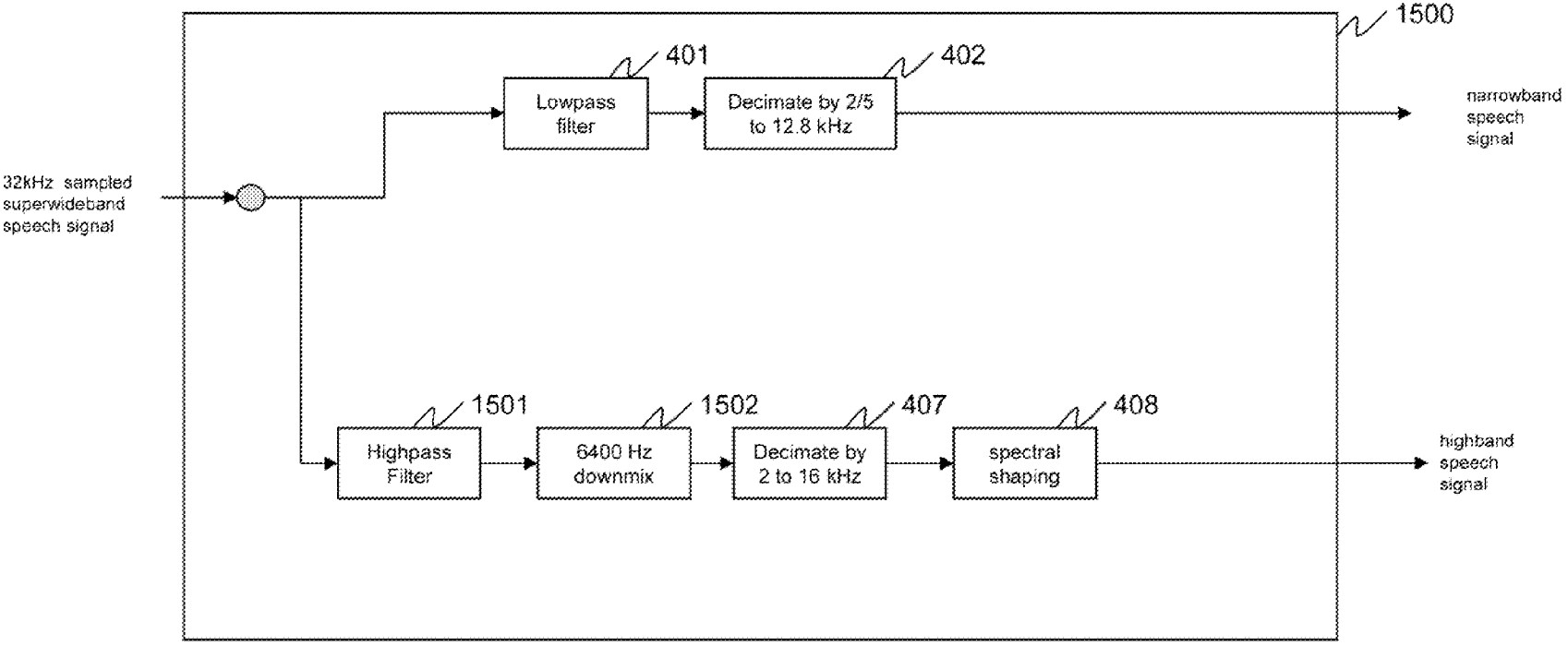
FIG. 15 is an alternative block diagram of a filter bank

FIG. 15 is a block diagram of an alternative embodiment of the filter bank. As is evident, the filter of FIG. 15 comprises downmixing circuitry 1502. In this case downmixing circuitry 1502 serves to downmix a highpass filtered version of the input signal; filtered by filter 1501. Unlike the prior-described filter bank where preprocessing of the signal into the downmixer comprises a spectral reversal operation, in this particular embodiment, the preprocessing of the signal that is fed into downmixer 1502 comprises high-pass filtering.

Figure 16:
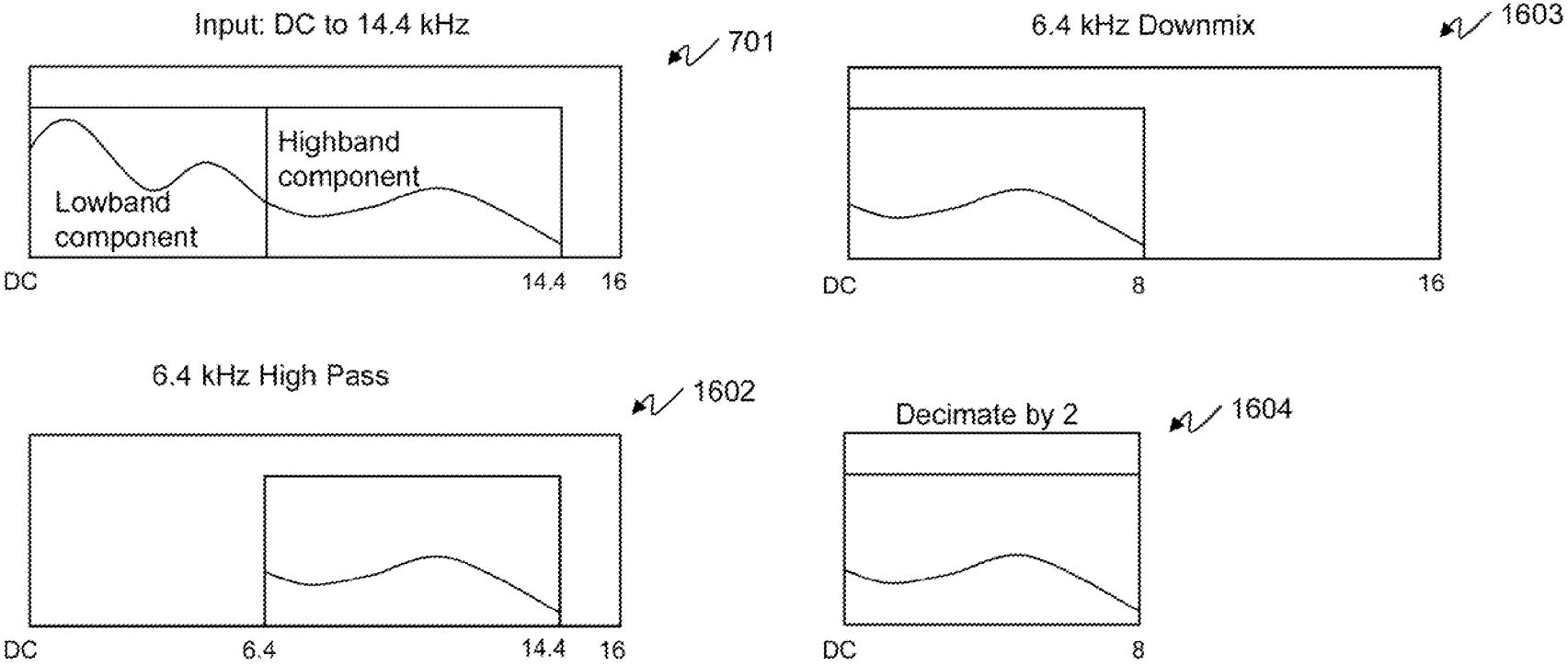
FIG. 16 illustrates filtering with the filter bank of FIG. 15

FIG. 16 illustrates filtering with the filter bank of FIG. 15. The input signal 701 into highpass filter 1501 comprises a 32 kHz sampled signal occupying a bandwidth of 14.4 kHz with a highband component and a lowband component (sometimes referred to as a narrowband component). After filtering (1602), the resulting signal exists between 6.4 kHz and 14.4 kHz. During downmixing by downmixer 1502, the resulting highband component is shifted in frequency by 6400 Hz (1603). Finally, the 16 kHz signal is decimated by 2 via decimator 407, resulting in signal 1604. By comparing FIG. 16 with FIG. 7 it will be observed that the two filtering operations both result in critical sampled versions of the highband component, however each is the spectral mirror of the other.

While the invention has been particularly shown and described with reference to a particular embodiment, it will be understood by those skilled in the art that various changes in form and details may be made therein without departing from the spirit and scope of the invention. For example, although the coding of super wideband signals is described above, it should be clear that this technology would be equally applicable to encoding the highband or indeed mid-band of a full-band audio signal (20 Hz-20 kHz). It is intended that such changes come within the scope of the following claims:

The invention claimed is:

1. A method for encoding a signal, the method comprising:

receiving a wideband speech signal at a filter bank;

filtering the wideband signal to produce a lowband signal and a highband signal;

encoding the lowband signal with a first encoder; and encoding the highband signal with a second encoder; wherein the step of filtering the wideband signal to produce the highband signal comprises:

preprocessing the wideband signal to produce a preprocessed signal; and performing a downmixing operation on the preprocessed signal, the downmixing operation including performing a Hilbert Transform on the preprocessed signal to produce two quadrature versions, real and imaginary, of the preprocessed signal;

mixing the two quadrature versions, real and imaginary, of the preprocessed signal with a cosine and a sine function, respectively, to produce mixed signals; and adding the mixed signals together.

2. The method of claim 1, wherein the downmixing operation is performed on the preprocessed signal to produce a down mixed signal.

3. The method of claim 2 wherein the step of filtering the wideband signal to produce the highband signal further comprises:

decimating the down mixed signal to produce a decimated signal; and spectrally shaping the decimated signal.

4. The method of claim 1, wherein the step of preprocessing the wideband signal to produce a preprocessed signal includes spectrally-reversing the wideband signal to produce a spectrally-reversed signal.

5. The method of claim 1, wherein the step of preprocessing the wideband speech signal includes a high-pass filtering operation.

6. A method for decoding a signal, the method comprising:

decoding a first signal with a first decoder to produce a lowband signal;

decoding a second signal with a second decoder to produce highband signal; and filtering the lowband and the highband signals to produce a wideband speech signal by preprocessing the highband signal to produce a preprocessed signal, and performing a downmixing operation on the preprocessed signal, wherein the downmixing operation includes:

performing a Hilbert Transform operation on the preprocessed signal to produce two quadrature versions. real and imaginary, of the preprocessed signal;

mixing the two quadrature versions. real and imaginary, of the preprocessed signal with a cosine and a sine function, respectively, to produce mixed signals; and adding the mixed signals together.

7. The method of claim 6 wherein the downmixing operation is performed on the preprocessed signal to produce a down mixed signal.

8. The method of claim 7 wherein the step of filtering the lowband and the highband signals includes adding the down mixed signal with a lowband signal.

9. The method of claim 6, wherein the step of preprocessing the highband signal includes a high-pass filtering operation.

10. The method of claim 6, wherein the step of preprocessing the highband signal includes a spectral reversal operation.

11. An apparatus comprising:

a filter bank receiving a wideband speech signal and outputting a lowband signal and a highband signal;

a first encoder encoding the lowband signal; and a second encoder encoding the highband signal, wherein the filter bank comprises:

preprocessing circuitry preprocessing the wideband signal to produce- a preprocessed signal; and downmixing circuitry downmixing the preprocessed signal to produce a down mixed signal, wherein the downmixing circuitry includes:

Hilbert Transform circuitry performing a Hilbert Transform on the preprocessed signal to produce two quadrature versions, real and imaginary, of the preprocessed signal;

a pair of mixers mixing the two quadrature versions, real and imaginary, of the preprocessed signal with a cosine and a sine function, respectively, to produce mixed signals; and an adder adding the mixed signals together.

12. The apparatus of claim 11, wherein the preprocessing circuitry spectrally reverses the wideband speech signal to produce a spectrally-reversed signal; and the downmixing circuitry downmixes the spectrally-reversed signal to produce a down mixed signal.

13. The apparatus of claim 11, wherein the filter bank further comprises:

decimating circuitry decimating the down mixed signal; and shaping circuitry spectrally shaping the decimated signal.

14. The apparatus of claim 11, wherein the preprocessing circuitry high-pass filters the wideband speech signal to produce a high-pass filtered signal.

15. An apparatus for decoding speech signals comprising:

a first decoder decoding a first signal to produce a lowband signal;

a second decoder decoding a second signal to produce highband signal;

preprocessing circuitry preprocessing the highband signal to produce a preprocessed signal:

downmixing circuitry that downmixes the preprocessed signal to produce a down mixed signal, wherein the downmixing circuitry includes:

Hilbert Transform circuitry performing a Hilbert Transform on the preprocessed signal to produce two quadrature versions, real and imaginary, of the preprocessed signal;

a pair of mixers mixing the two quadrature versions, real and imaginary, of the preprocessed signal with a cosine and a sine function, respectively, to produce the down mixed signal; and an adder adding the down mixed signal with the lowband signal.

16. The apparatus of claim 15, wherein the preprocessing circuitry spectrally reverses the highband signal to produce a spectrally-reversed signal; and wherein the downmixing circuitry downmixes the spectrally-reversed signal to produce a down mixed signal.

17. The apparatus of claim 15, wherein the preprocessing circuitry high-pass filters the wideband speech signal to produce a high-pass filtered signal.

* * * * *